US009862536B2

(12) United States Patent
Arora et al.

(10) Patent No.: US 9,862,536 B2
(45) Date of Patent: Jan. 9, 2018

(54) AEROSOL DISPENSER HEAD

(71) Applicant: Conopco, Inc., Englewood Cliffs, NJ (US)

(72) Inventors: Amit Arora, Leeds (GB); Richard Chambers, Leeds (GB); Paul Roger Griffin, Redditch (GB); Eleanor Rachel Ann Hyde, Leeds (GB); Christopher John Jones, Tewkesbury (GB); Geoffrey Stephen Mawtus, Billund (DK); James Edward Roe, Buxton (GB); Jason Peter Roebuck, Glossop (GB); Peter William Tune, South Duffield (GB); Andrew Gordon Wallace, Highleadon (GB)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

(21) Appl. No.: 15/039,862

(22) PCT Filed: Nov. 25, 2014

(86) PCT No.: PCT/EP2014/075505

§ 371 (c)(1),
(2) Date: May 27, 2016

(87) PCT Pub. No.: WO2015/086306

PCT Pub. Date: Jun. 18, 2015

(65) Prior Publication Data

US 2017/0029201 A1 Feb. 2, 2017

(30) Foreign Application Priority Data

Dec. 9, 2013 (EP) ..... 13196202

(51) Int. Cl.
*B65D 83/30* (2006.01)
*B65D 83/20* (2006.01)

(52) U.S. Cl.
CPC ..... *B65D 83/303* (2013.01); *B65D 83/205* (2013.01)

(58) Field of Classification Search
CPC ..... B65D 83/303; B65D 83/205
(Continued)

(56) References Cited

U.S. PATENT DOCUMENTS 5,480,095 A 1/1996 Stevenson et al.
7,886,939 B2 * 2/2011 Michaux ..... B05B 11/3015 222/383.1

(Continued)

FOREIGN PATENT DOCUMENTS

EP 2058054 5/2009
WO WO10041411 4/2010

(Continued)

OTHER PUBLICATIONS

IPRP in PCTEP2014075505 dated Feb. 26, 2016. pp. 1 to 11.

(Continued)

*Primary Examiner* — Donnell Long
(74) *Attorney, Agent, or Firm* — Karen E. Klumas

(57) ABSTRACT

A dispenser head for an aerosol can and a method of assembly of the same, the dispenser head comprising a chassis attached to the associated aerosol can and a spray-through cap attached thereto, the chassis comprising a platform capable of axial movement and a flexible spray channel centrally located thereon.

12 Claims, 14 Drawing Sheets

(58) Field of Classification Search
USPC ..... 222/402.13, 383.3, 402.1, 153.14
See application file for complete search history.

(56) References Cited

U.S. PATENT DOCUMENTS

| | | | | |
|---|---|---|---|---|
| 7,984,827 | B2 * | 7/2011 | Hygema | B65D 83/205 222/153.11 |
| 8,387,827 | B2 * | 3/2013 | Helf | A01M 1/2038 222/402.21 |
| 2004/0112924 | A1 * | 6/2004 | Albisetti | B65D 83/206 222/402.13 |
| 2008/0116232 | A1 * | 5/2008 | Michaux | B05B 11/3049 222/507 |
| 2008/0164285 | A1 | 7/2008 | Hygema | |
| 2011/0233235 | A1 * | 9/2011 | Adams | B65D 83/205 222/402.13 |
| 2012/0097713 | A1 * | 4/2012 | MacKinnon | B65D 83/206 222/402.13 |

FOREIGN PATENT DOCUMENTS

| | | |
|---|---|---|
| WO | WO10092775 | 8/2010 |
| WO | WO2011003752 | 1/2011 |

OTHER PUBLICATIONS

Search Report and Written Opinion in PCTEP2014075505 dated Feb. 6, 2015. pp. 12 to 22.
Search Report and Written Opinion in EP13196202 dated May 8, 2014. pp. 23 to 28.

* cited by examiner

AEROSOL DISPENSER HEAD

FIELD OF INVENTION

The present invention is in the field of dispenser head assemblies for use with conventional aerosol cans. More particularly, it relates to spray-through caps methods for their manufacture.

BACKGROUND

Aerosol cans have traditionally been used with an actuator comprising a button, pressure upon which causing release of the contents of the aerosol can via a valve present in the centre of a valve cup at the top of the can. Such actuators are typically used with a removable cap, giving the benefit of preventing accidental discharge via inadvertent pressure upon the actuator button. Other actuators for aerosol cans comprise a so-called 'spray-through cap', i.e., one that can be left in place during spraying, the spray exiting the cap through an orifice therein. Actuators comprising a spray-through cap often comprise some form of locking means to prevent accidental discharge via inadvertent pressure upon the actuator button.

The present invention is concerned with actuators comprising a spray-through cap and a flexible spray channel held between the valve stem of an associated aerosol can and a holding feature present within the spray-through cap. There are some related prior art publications, but none giving all the benefits of the present invention.

WO 11/003752 (Unilever, 2011) discloses an actuator comprising a spray-through cap having an actuator button located on its side. Inside there is a chassis with depressible platform and a centrally located spray channel linking the valve stem of an associated aerosol can to spray orifice.

U.S. Pat. No. 7,984,827 B2 (Precision Valve, 2011) discloses a lockable aerosol valve actuator with a rotatable top portion. In the dispenser described, the opening in the over-cap only aligns with the nozzle outlet when the dispenser is in its unlocked position.

WO 10/092775 and WO 10/041411 (both Canyon Corp., 2010) disclose a pump dispenser with a flexible spray channel.

SUMMARY OF THE INVENTION

In a first aspect of the present invention, there is provided an aerosol dispenser head comprising a chassis and a spray-through cap, the chassis comprising:

- an annular ring capable of attachment to an associated aerosol container; a platform surrounded by and attached to the annular ring by struts allowing the platform to rise and fall relative to the annular ring;
- a flexible spray channel rising vertically from the centre of the platform and being attached at its lower end to a valve stem of an associated aerosol can and its outer end being capable of allowing egress of the contents of the associated aerosol container; and the spray-through cap comprising:

- means for attachment to the chassis or the associated aerosol can;
- an actuator button, pressure upon which causes downward pressure on the platform of the chassis and consequential downward pressure upon the valve stem attached to the lower end of the associated spray channel; and
- an aperture positioned to surround the outer end of the spray channel;

the chassis or the spray-through cap further comprising means for holding the flexible spray channel at a pre-selected angle of bend.

In a second aspect of the present invention, there is provided a method of spraying a cosmetic composition onto the surface of the human body comprising the use of an aerosol dispenser head according to the first aspect of the invention.

In a third aspect of the present invention, there is provided a method of assembly of an aerosol dispenser comprising the steps of:

1. attaching a spray-through cap comprising an aperture to a chassis comprising an annular ring surrounding and attached to a platform capable of axial movement by means of struts between the annular ring and the platform, the chassis comprising a flexible spray channel rising vertically from the centre of the platform and being held at a pre-selected angle of bend by a retaining feature of the chassis and
2. attaching the spray-through cap-chassis assembly to an aerosol can comprising a depressible release valve such that the flexible spray channel is attached at its lower end to the upper end of a valve stem of the depressible valve of the aerosol can, wherein the angle of bend of the spray channel is pre-selected such that the aperture in the spray-through cap surrounds the terminal end of the spray channel.

In a fourth aspect of the invention there is provided moulding tools suitable for use in the manufacture of an aerosol dispenser head according to the first aspect of the invention.

In a preferred variant on the above fourth aspect of the invention, the mould for the means for holding the flexible spray channel at a pre-selected angle of bend is independently interchangeable with an alternative mould or moulds, resulting in an alternative angle(s) of bend for the flexible spray channel.

DETAILED DESCRIPTION

The present invention provides for an aerosol dispenser head that is easy to assemble and to use. Further, the invention incorporates an ease and flexibility of manufacture, enabling multiple actuators to be assembled with minimal process modification. This benefit comes in part from the flexible spray channel, which can be bent to wherever it is desired to exit a particular spray-through cap with which it is used.

In conventional aerosol dispenser head manufacture, the spray channel is not moulded together with the component that attaches it to the associated aerosol can, herein the chassis. This is possible with dispenser heads according to the present invention and this significantly simplifies manufacture. This is possible because the spray channel is moulded as a straight, vertical feature and is only later bent into its desired final position.

Flexibility in manufacture is enhanced by having a means for holding the flexible spray channel at a pre-selected angle of bend. By simple replacement of this means with another allowing a different angle of bend, together with an appropriately amended spray-through cap, one can easily transform the appearance of the resulting dispenser head.

In a further aspect of the invention, there is provided a method of manufacture of an aerosol dispenser wherein a chassis comprising the features as detailed in the first aspect of the invention may be attached to a variety of spray-through caps comprising the features as detailed in the first aspect of the invention to generate a variety of aerosol dispensers.

In preferred embodiments of the invention, the chassis comprises means for holding the flexible spray channel at a pre-selected angle of bend. In such embodiments, it is typical for the spray-through cap not to comprise means for holding the flexible spray channel at a pre-selected angle of bend. In each of these preferred embodiments and in other embodiments, it is typical for the spray-through cap to comprise means for attachment to the chassis.

When the means for holding the spray channel at a pre-selected angle of bend is part of the chassis, it is non-central with respect to the horizontal cross-section of the chassis and typically interacts with a portion of the spray channel towards its terminal end. In certain embodiments, it comprises a hook or eye that interacts with a corresponding hook or eye that is a portion of the spray channel.

In preferred embodiments, the dispenser head comprises a locking means, preventing accidental discharge via inadvertent pressure upon the actuator button. In particularly preferred embodiments, the dispenser head comprises a locking collar that interacts with the chassis platform to allow or prevent depression thereof dependent upon its rotational positioning relative thereto. The locking collar may prevent depression of the chassis platform via interaction of a protrusion from the collar with a feature on the platform in a first relative rotational positioning, rotation of this protrusion to a second relative rotational positioning allowing depression of the platform.

In further preferred embodiments, the annular ring of the chassis comprises an upstanding annular wall, a portion of which projects through a partial annular gap in the locking collar as described in paragraph immediately above. This enhances the robustness of the design and the effective functioning of the locking collar. Preferably, the upstanding annular wall comprises a retaining feature that aids retention of the spray-through cap when this is added. A lip or bead that interacts with a corresponding feature on the spray-through cap is suitable for this purpose.

In preferred embodiments of the invention, the platform of the chassis is centrally located within the annular ring thereof. This aids the balance of forces and pressures exerted upon the platform and passed to the valve stem of the associated aerosol can.

Herein, preferred features should be understood as being independently applicable to the various aspects of the invention, although functionally related preferred features should be understood as being applicable independently or in combination.

Herein, the word "comprising" should be understood to be non-exhaustive, i.e., to include the possibility that other components or steps are also involved.

Herein, orientation terms such as "horizontal/vertical", "upper/lower" and "upward/downward" should be understood to refer to the aerosol dispenser head oriented in an upright manner as it would be on top of an upright aerosol can with which it is designed for use.

Herein, the "front" of the aerosol dispenser head refers to the face or portion bearing the spray outlet and "rear" refers to the face or portion away from the spray outlet.

Herein, the pressure upon the actuator button which causes downward pressure on the chassis platform may be in any direction, but is typically downward.

Herein, "moulding tools" includes moulds for components.

Herein, the "pre-determined angle of bend" for the flexible spray channel may be from 180° (i.e. straight) to 90° (i.e. bent from vertical at the bottom to horizontal at the terminal end).

The pre-determined angle of bend is preferably less 180°, more preferably less than 165° and most preferably less than 150°. For each of these preferences, the pre-determined angle of bend is also preferred to be greater than 90° C.

The actuator button used in accordance with the present invention preferably comprises a keel protruding downwards from its inner surface. This keel functions to transfer pressure on the actuator button into downward pressure upon the platform of the chassis. In preferred embodiments, two such keels may be employed, orientated to equalise the pressure applied on either side of the valve stem of an associated aerosol can. The two keels may be located at an equal distance on either side of the valve stem, along a straight line passing through the valve stem, in order to achieve such pressure equalisation.

The pressure exerted by a keel as described in the above paragraph may be transferred to the chassis platform with the aid of a wall, preferably two walls, projecting upwards from the chassis platform. Such wall or walls can aid in the equalisation of the pressure brought to bear on platform.

The struts attaching the platform of the chassis to the annular ring of the chassis are preferably flexible, in order to ease axial movement of the platform relative to the annular ring. The flexibility in the struts may come from material selection and/or their mechanical design. In preferred embodiments the struts are hinged to aid their flexibility. The struts preferably number from 2 to 8, more preferably from 2 to 4 and most preferably 3.

The components of the actuator cap are typically made from plastic. The spray-through cap and chassis may be made from polypropylene, as may the spray channel. The swirl chamber, if employed, is typically made using a spray insert preferably made from acetal.

The method of assembly described above as the "third aspect of the invention" involves the spray-through cap being attached to the chassis before the assembly thereby generated is attached to the aerosol can. Typically, the means for attachment of the assembly to the aerosol can comprises attachment means on the chassis; this typically attaching to a valve cup of the aerosol can.

In a preferred preliminary step of the method of assembly, the flexible spray channel is moulded in a straight vertical orientation and is subsequently bent to a pre-determined angle of less than 180° and secured at such angle by the retaining feature of the chassis. This method allows for easy moulding of the chassis and flexibility in the final chassis design, allow post-moulding bending of the spray channel to accommodate the particular spray-through cap chosen. A preferred and advantageous feature of above preliminary step of the method of assembly is that the flexible spray channel is moulded in one piece together with the other components of the chassis.

The method of assembly preferably includes the combination of the components described in the above paragraph with a locking collar. In such methods, a portion of the annular ring of the chassis is preferably pushed upwards through a partial annular gap in the locking collar before the chassis is attached to the aerosol can.

In preferred methods of assembly including combination with a locking collar, a portion of the annular ring of the chassis is pushed upwards through the partial annular gap in the locking collar before the spray-through cap is attached to the chassis.

The features described with reference to the following specific embodiments may be incorporated independently into the generic description given above and/or as given in the claims.

Figure 1:
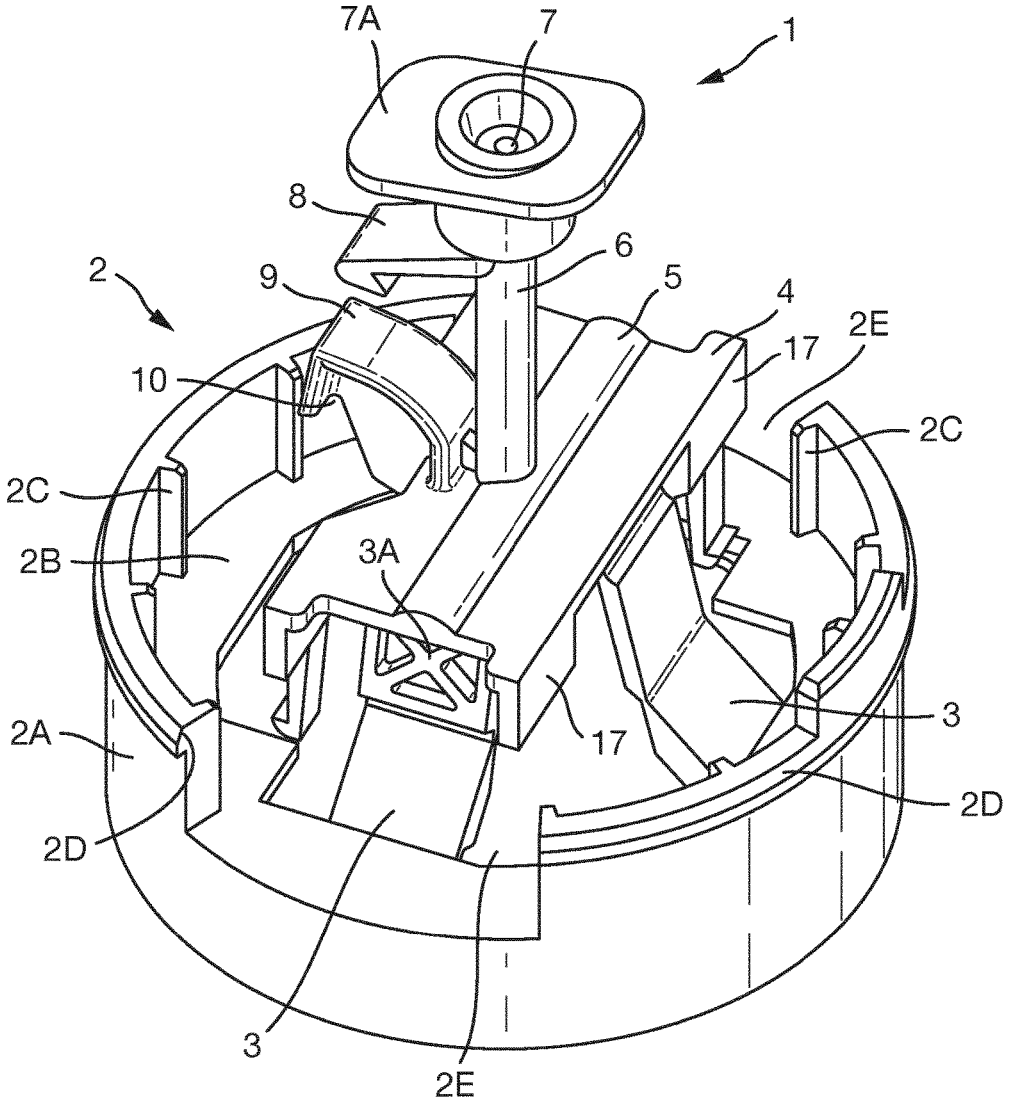
FIG. 1 is a pre-assembly view of a chassis (1) of an aerosol dispenser head suitable for use in accordance with the present invention. The chassis (1) has its spray channel (6) in vertical orientation in this Figure.
Figure 2:
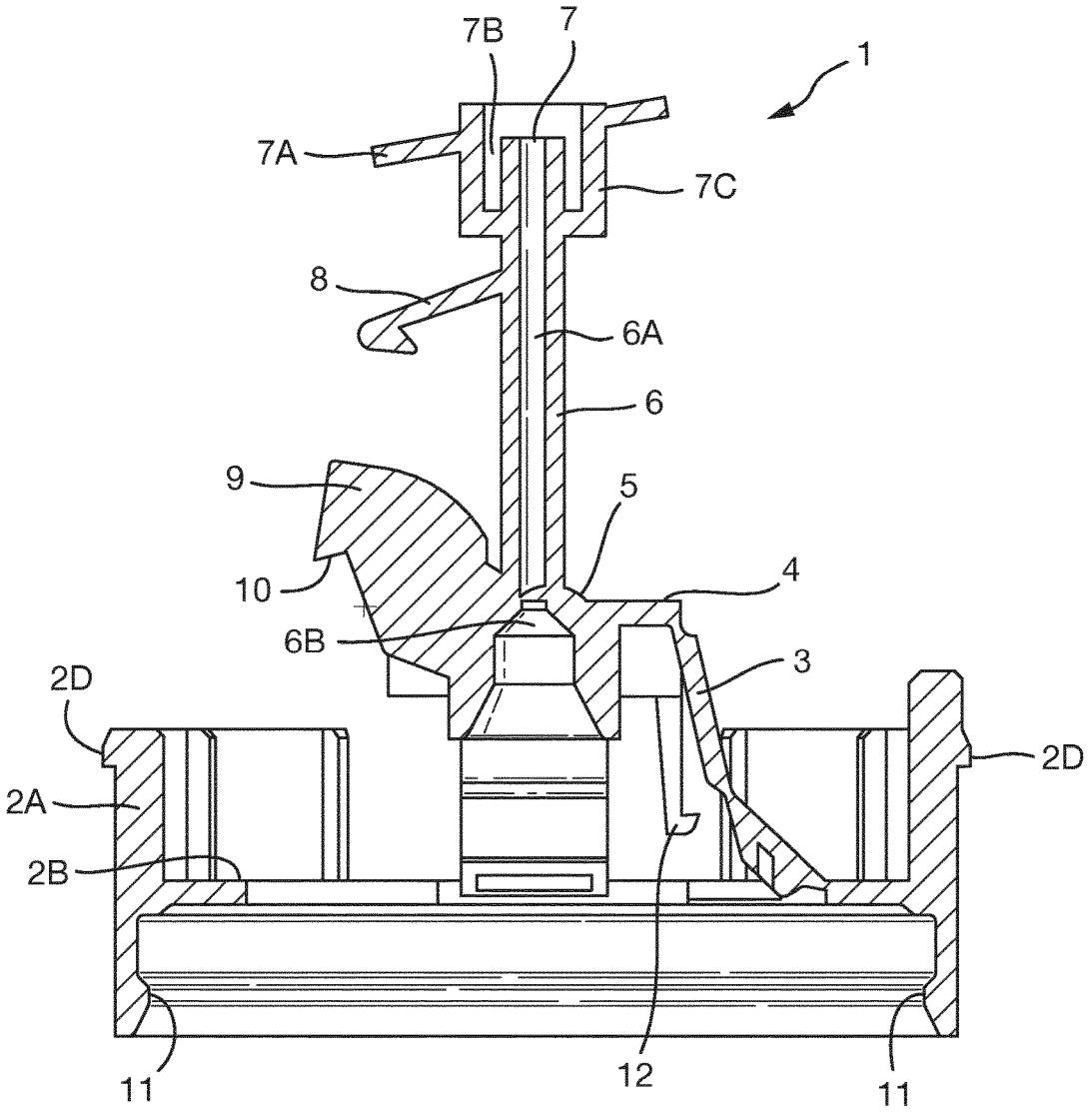
FIG. 2 is a vertical cross-section of the chassis (1) as in FIG. 1, the cross-section being midway along the long axis of the oblong platform (4) and orthogonal thereto.
Figure 3:
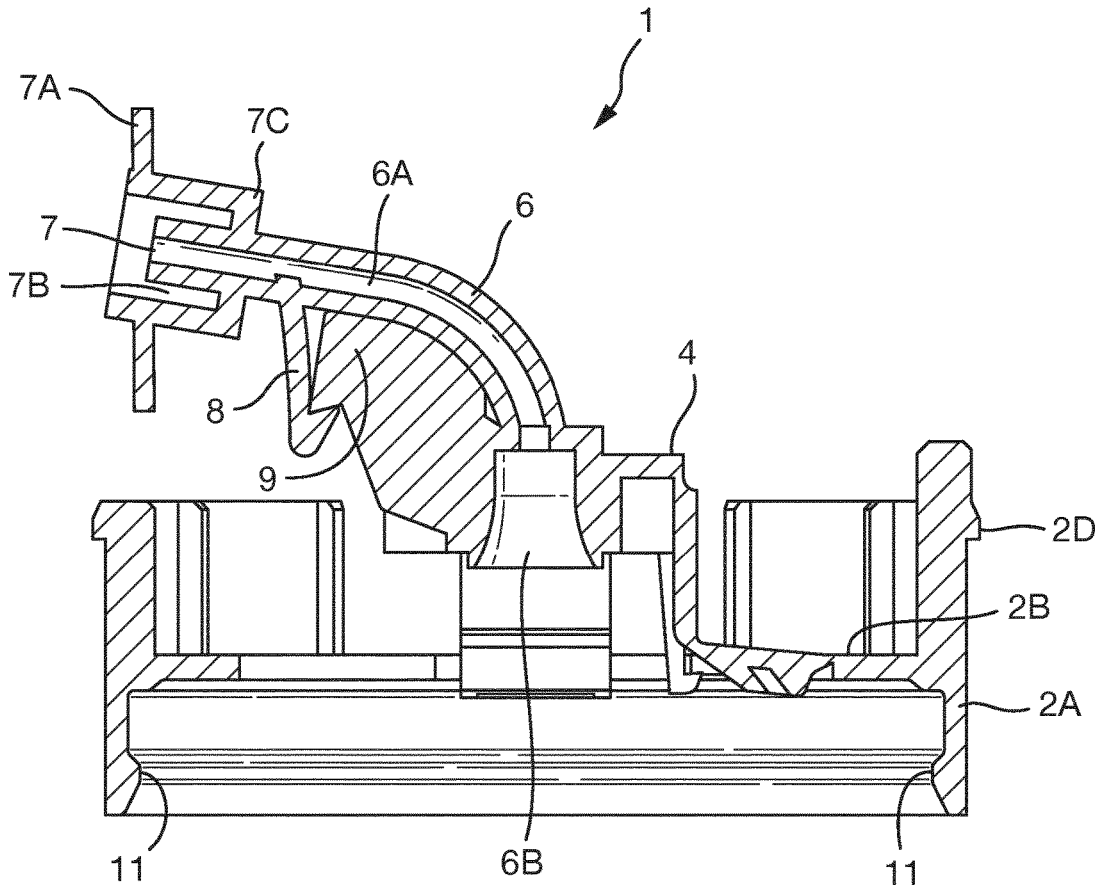
FIG. 3 is similar to FIG. 2, but with the flexible spray channel (6) bent over and the hook feature (8) thereof held by the retaining feature (9) and with the oblong platform (4) being positioned ready for actuation.

With reference to FIGS. 1 to 3, the chassis (1) comprises an annular ring (2) designed for attachment to the valve cup of an associated aerosol can (not shown). The annular ring (2) is comprised of annular wall (2A) and an annular platform (2B) that protrudes horizontally inwards from the annular wall (2A).

Protruding from the internal surface of the annular wall (2A) above the annular platform (26), there are multiple vertical strengthening pillars (20) that add to the resilience of the chassis (1).

Protruding from the external surface of the annular wall (2A) at its top, there is a lip (2D), designed to interact with the spray-through cap (18) and aid its retention (vide infra).

Centrally located within the annular ring (2) and linked to the annular platform (2B) by three flexible struts (3) is an oblong platform (4) capable of axially movement relative to the annular ring (2). The flexible struts (3) are centrally hinged to aid their flexibility. Two of the flexible struts (3) attach to opposite ends of the oblong platform (4) along its long axis; the third is at right angles to these. The former two flexible struts (3) are perforated to leave a cross design (3A) on their upper parts to reduce material usage and enhance resilience. The latter flexible strut (3) is imperforated.

A bevelled hump (5) rises from the top surface of the oblong platform (4) along its long axis at its centre.

The sections of the annular ring (2) adjacent to the opposite ends of the oblong platform (4) along its long axis have cut-away sections (2E) in the part of the annular wall (2A) extending above the annular platform (2B). These serve to accommodate features of the locking collar (13) (vide infra).

Rising vertically from the centre of the oblong platform (4) there is a flexible spray channel (6). It is shown in vertical orientation in FIG. 1; however, it is bent and locked into place during the assembly of the aerosol dispenser head (vide infra). At its lower end, the spray channel (6) is attachable to the valve stem of an associated aerosol can. At its outer end there is an exit orifice (7), allowing egress of the contents of the associated aerosol container when the valve of the latter is opened.

Surrounding the outer part of the spray channel (6), close to the exit orifice (7), there is a cylindrical outer shell (70) attached to the spray channel (6) at its lower end. There is a gap (7B) between the spray channel (6) and the cylindrical outer shell (70) which can serve to accommodate a swirl chamber (not illustrated), if so desired.

Surrounding the exit orifice (7) and the associated cylindrical outer shell (70) there is a masking plate (7A) which serves to mask a hole (20) in the associated spray through cap (18) (vide infra).

Towards the upper end of the spray channel (6), a hook feature (8) extends radially outwards in a direction away from that in which the imperforated flexible strut (3) radially extends.

Rising from the top surface of the oblong platform (4) is a spray channel retaining feature (9). The spray channel retaining feature (9) extends radially away in a direction parallel to the hook feature and projects upwards in arcuate cross-section. The spray channel retaining feature (9) has an indent (10) in its lower side designed to capture the hook feature (8) of the flexible spray channel (6) when the latter is bent over towards it and snapped into place.

FIG. 2 additionally illustrates the bore (6A) of the flexible spray channel (6) and its valve socket (66), which sits on top of the valve stem of an associated aerosol can. Also illustrated is a bead (11) which snap connects the chassis (1) to the valve cup of the associated aerosol can with which it designed to be used. Also illustrated is a restraining hook (12) used in assembly to hold the oblong platform (4) and associated features in their pre-caution position. The restraining hook (12) locks under the annular platform (2B) to achieve this.

FIG. 3 illustrates the chassis (1) with the flexible valve stem (6) bent over and the hook feature (8) thereof held by the retaining feature (9) also rising from the top surface of the oblong platform (4). In this Figure, it will also be noticed that the imperforated flexible strut (3) is bent to almost 90°, the oblong platform (4) being in its pre-actuation position.

Figure 4:
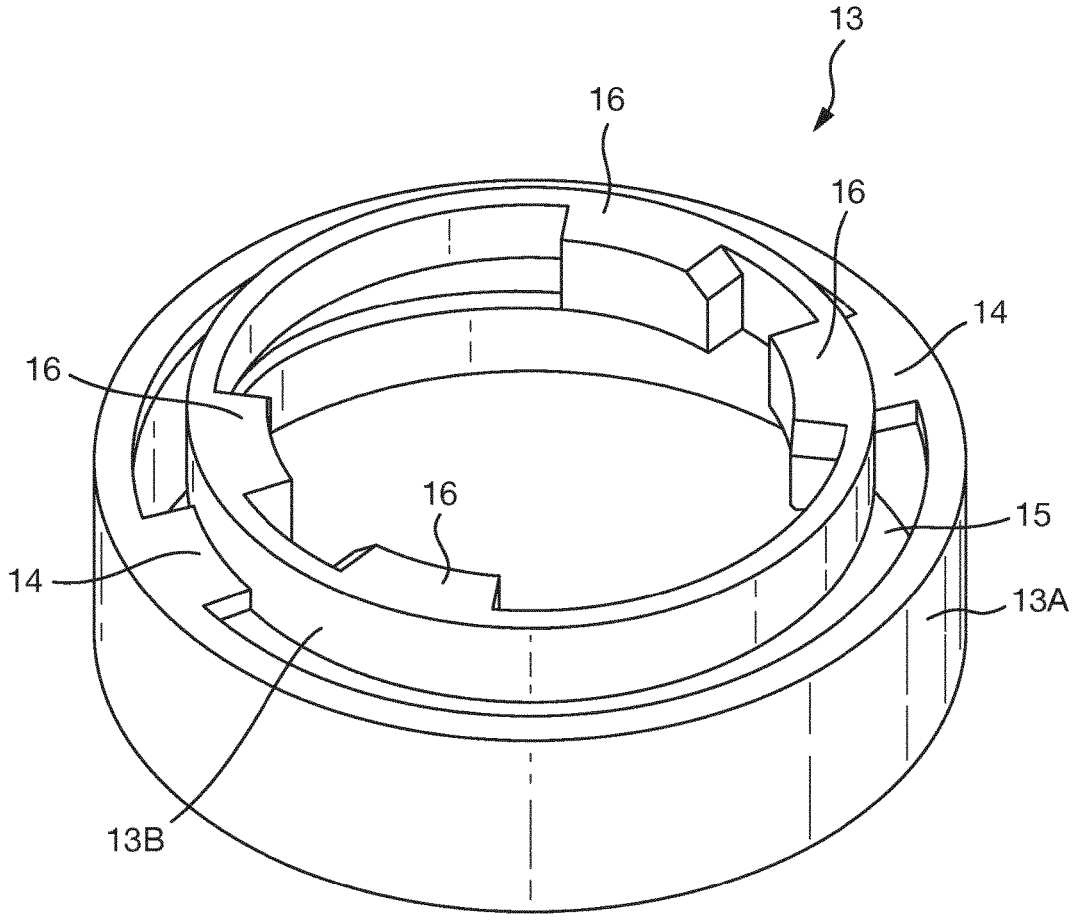
FIG. 4 is a view of a locking collar (13) suitable for use with the chassis (1) illustrated in FIGS. 1 to 3.

FIG. 4 illustrates a locking collar (13) suitable for use with the chassis (1). The locking collar (13) comprises an outer collar (13A) and an inner collar (13B) concentric therewith, the two collars being held firmly together by two radially opposed horizontal linking struts (14). The inner collar (13B) is higher than the outer collar (13A) and the linking struts (14) link segments of the lower outer edge of the former with segments of the upper inner edge of the latter. The gap (15) between the outer collar (13A) and the inner collar (13B) is designed to accommodate the annular wall (2A) of the annular ring (2) when the dispenser head is assembled. When assembled, the linking struts (14) sit on the annular platform (2B) in the cut-away sections (2E) in the part of the annular wall (2A) extending above the annular platform (2B) (see FIG. 5).

Projecting inwards from the inner side of the inner collar (13B) are blocking elements (16). The blocking elements are radially located to either side of where each of the linking struts (14) contacts the lower outer edge of the inner collar (13B). The blocking elements (16) serve to block depression of the oblong platform (4) and associated spray channel (6) when the locking collar (13) is appropriately rotated (vide infra).

Figure 5:
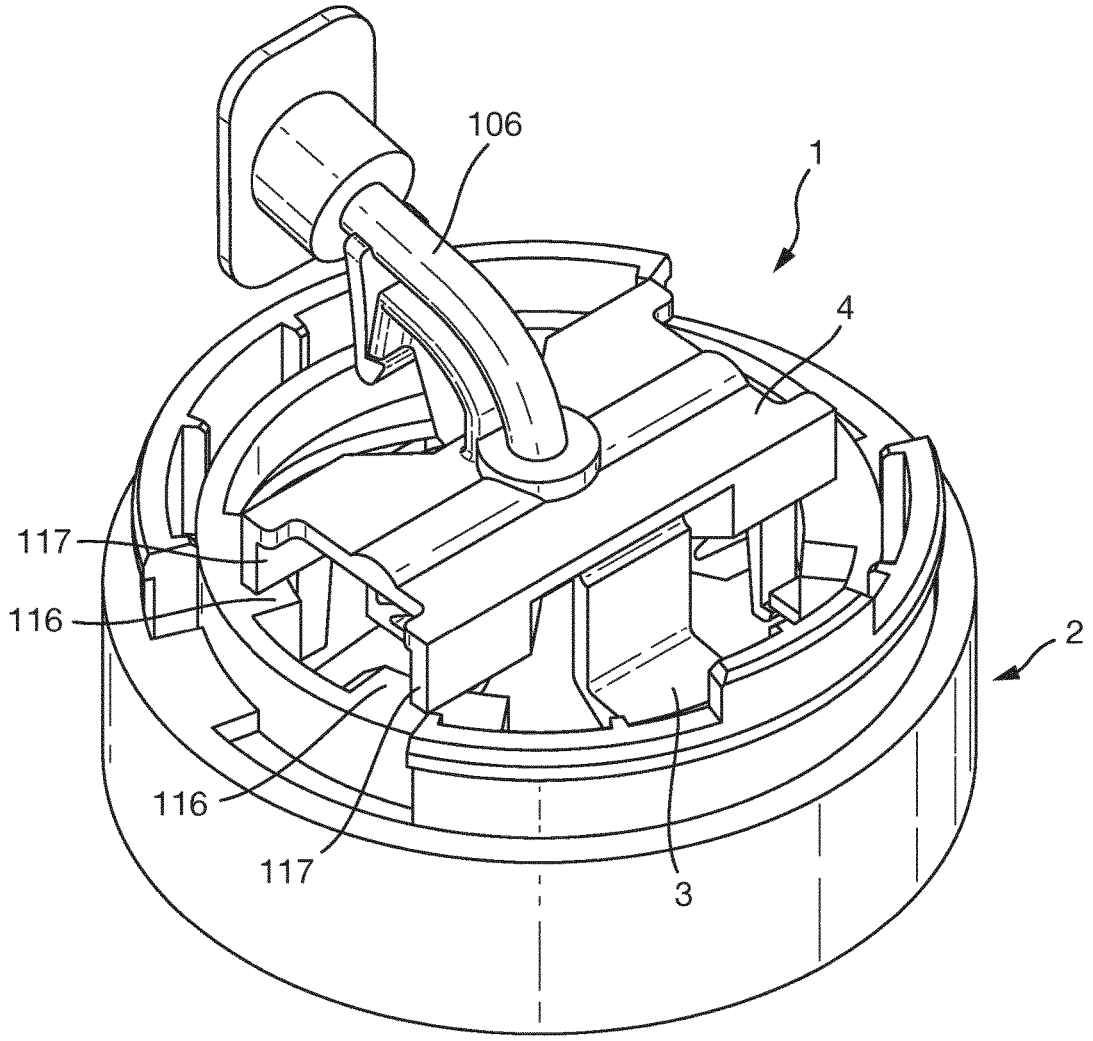
FIG. 5 is a view of the chassis (1) as illustrated in FIG. 1 and the locking collar (13) as illustrated in FIG. 4, the locking collar being positioned to prevent depression of the oblong platform (4).

The blocked position of the locking collar (13) is clearly illustrated in FIG. 5. Four blocking elements (16) interact with four downward projections (17) from the oblong platform (4) and thereby prevent depression of the latter. In contrast, when the locking collar (13) is rotated such that the blocking elements (16) are clear of the downward projections (17) from the oblong platform (4), the oblong platform (4) may be depressed by downward pressure thereupon.

Figure 6:
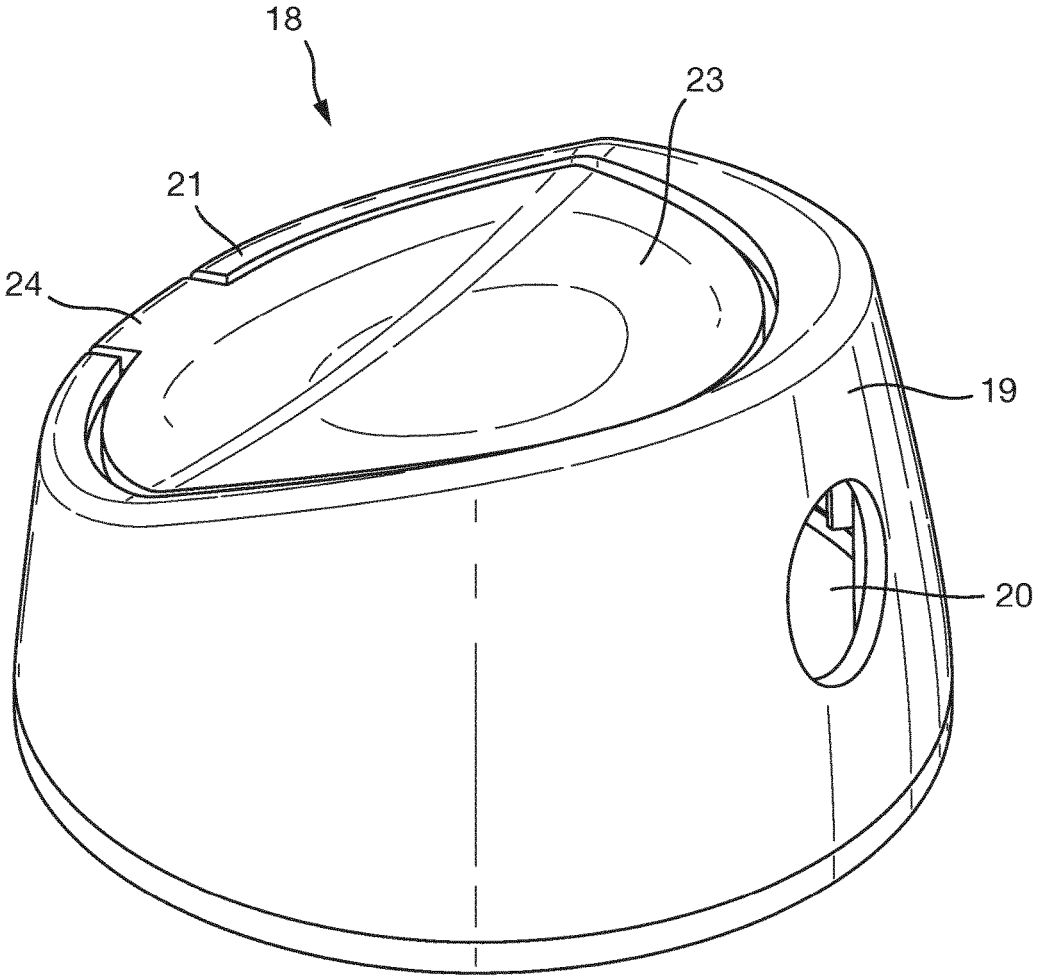
FIG. 6 is a view from above of a spray-through cap (18) suitable for use in accordance with the present invention.
Figure 7:
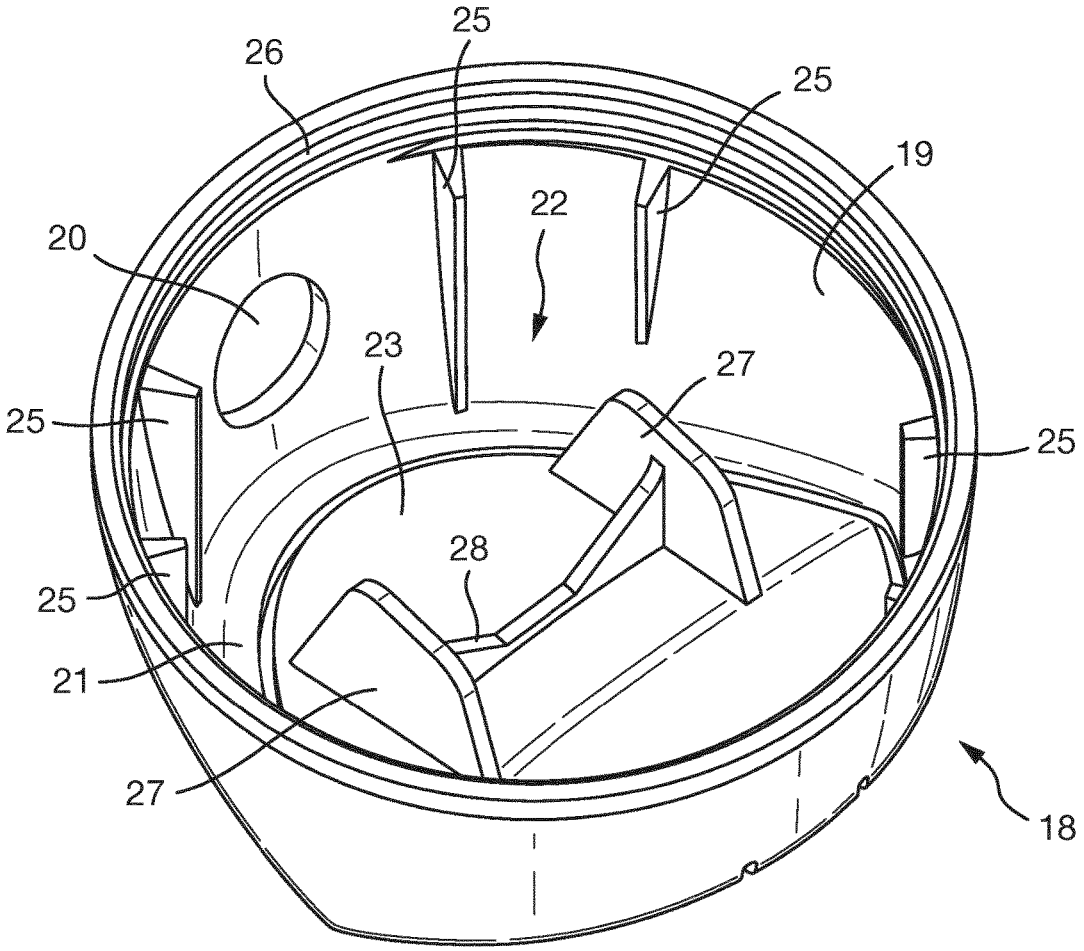
FIG. 7 is a view from below of the spray-through cap (18) illustrated in FIG. 6.

FIGS. 6 and 7 illustrate a spray-through cap (18) suitable for use in combination with the chassis (1) and locking collar (3) as described hereinabove. The spray-through cap (18) comprises an annular shell (19) defining an aperture (20) designed to accommodate the exit orifice (7) of the spray channel (6). The shell (19) is largely cylindrical in shape, but has a lip (21) slightly overlapping a central void (22) at its upper end.

Attached to the of the shell (19) at its upper edge facing away from the aperture (20) there is an actuator button (23). The actuator button (23) fills most of the top surface of the spray through cap (18) bordered by the lip (21) protruding inwards from the shell (19) thereof.

The actuator button (23) is linked to the shell (19) at its upper edge by a living hinge (24) located opposite the aperture (20) defined in the shell (19) of the spray-through cap (18).

Figure 8:
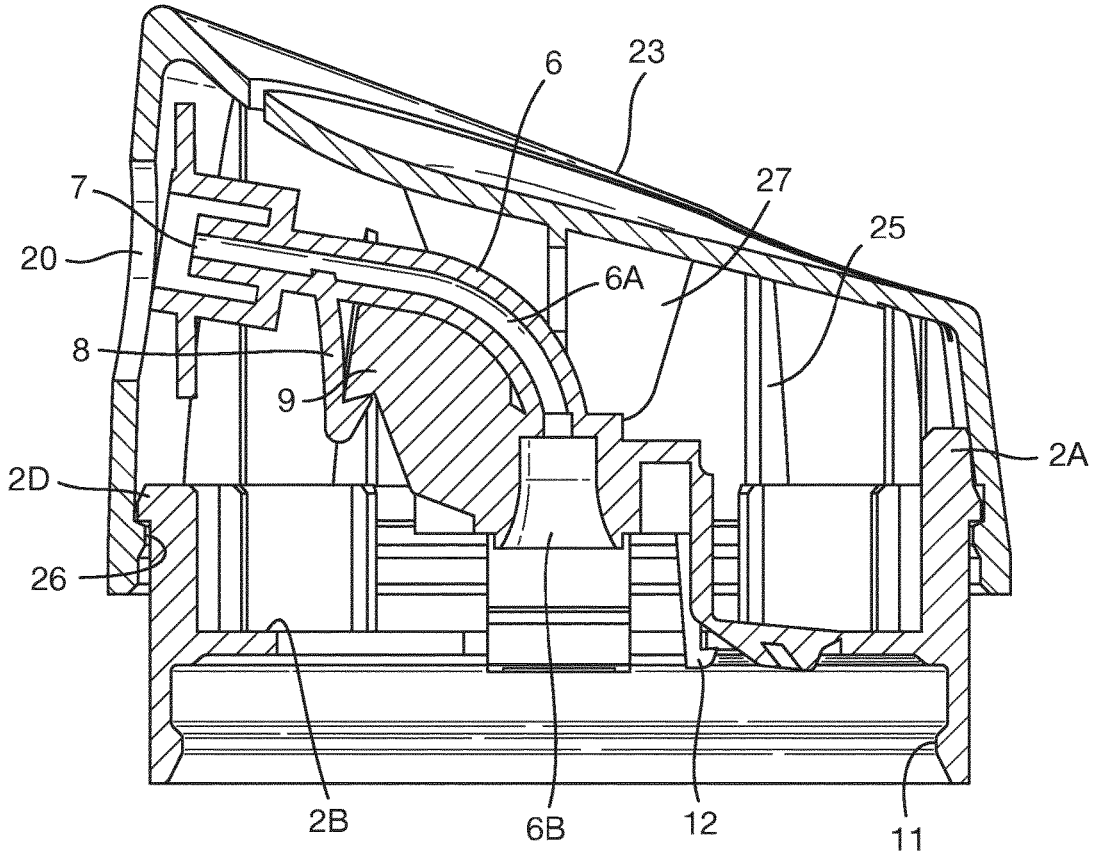
FIG. 8 is a cross-sectional view of the chassis (1) illustrated in FIGS. 1 to 3 in combination with the spray-through cap (18) illustrated in FIGS. 6 and 7.

With reference to FIG. 7, the shell (19) has several strengthening struts (25) located on its inner surface and running vertically for all or part of the total height of the shell (19). Protruding from the inner surface of the shell (19) towards it lower end there is an annular bead (26) designed to interact with the lip (2D) on the chassis (1) and aid the retention of the spray-through cap (18) on the chassis (1). These features are most clearly seen in FIG. 8.

The underside of the actuator button (23) comprises two downward protruding keels (27) having an arch-shaped support (28) therebetween. The high point of the arch-shaped support (28) accommodates the flexed spray channel (6) when the dispenser head is fully assembled.

Figure 14:
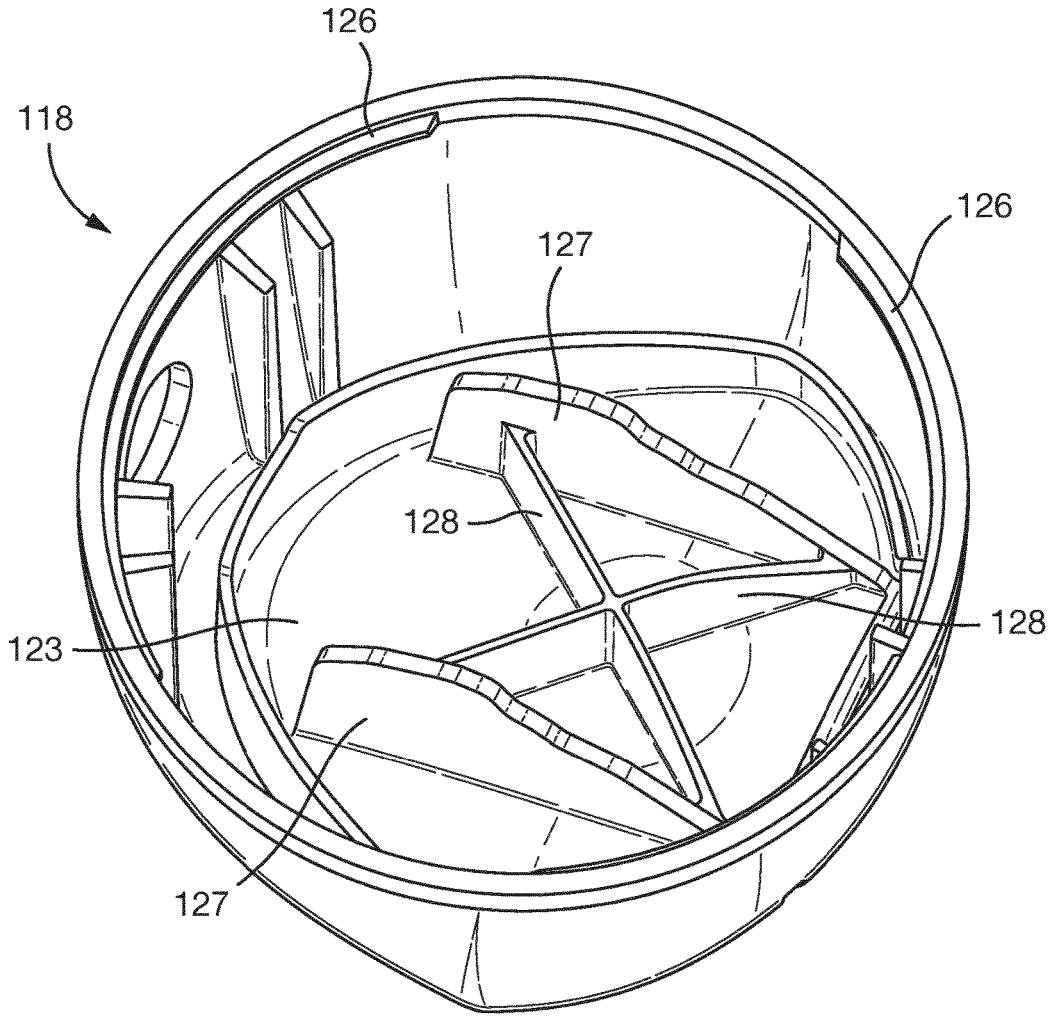
FIG. 14 is a view from below of an alternative spray-through cap (118) suitable for use in accordance with the present invention.

In an alternative embodiment of the spray-through cap (118) illustrated in FIG. 14, an actuator button (123) comprises two downward protruding keels (127) having a cross-beam support (128) therebetween.

When downward pressure is applied on the actuator button (23), the keels (27) press on the bevelled hump (5) on the top surface of the oblong platform (4) at points equidistant from the centrally located spray channel (6). When the locking collar (13) is in a position to allow depression of the oblong platform (4), the downward pressure on the bevelled hump (5) thereof causes the valve socket (6B) to press down upon the valve stem an associated aerosol container and thereby allow release of the contents of the later through the spray channel (6).

Figure 9:
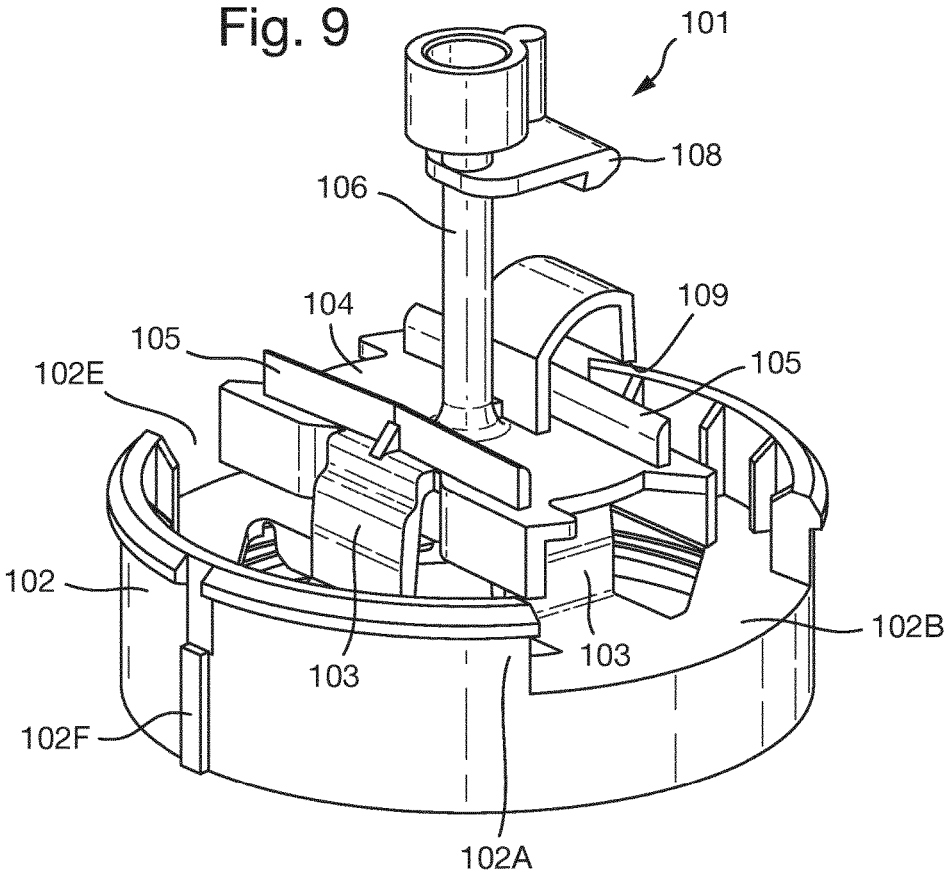
FIG. 9 is a pre-assembly view of an alternative chassis (101) of an aerosol dispenser head suitable for use in accordance with the present invention. The chassis (101) has its spray channel (106) in vertical orientation in this Figure.
Figure 10:
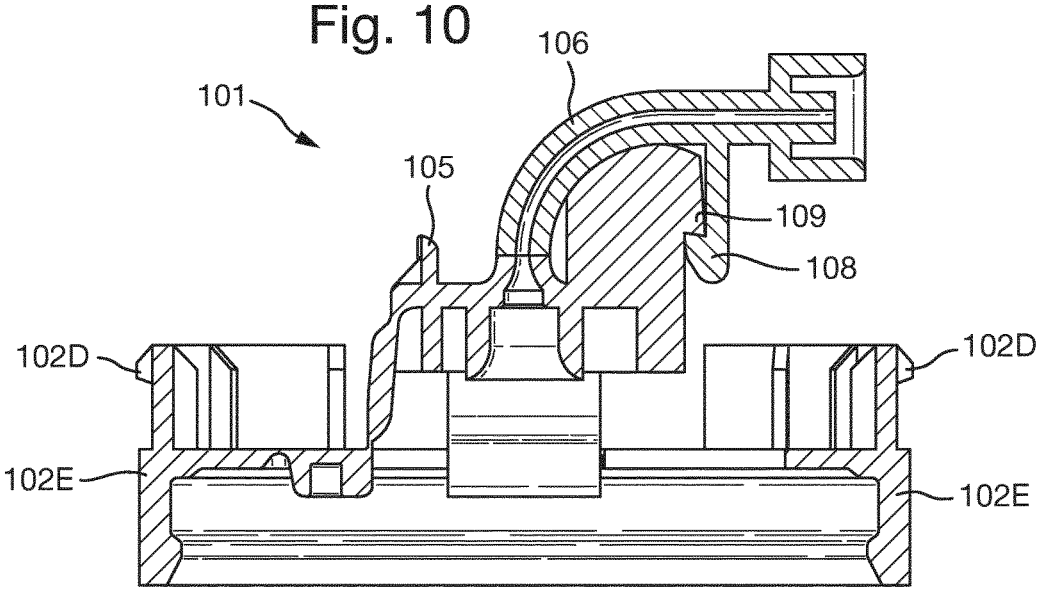
FIG. 10 is a vertical cross-section of the chassis (101) as in FIG. 9, the cross-section being midway along the long axis of the oblong platform (104) and orthogonal thereto. In this Figure, the flexible spray channel (106) is bent over and the hook feature (108) thereof held by the retaining feature (109).

With reference to FIGS. 9 and 10, an alternative chassis (101) comprises an annular ring (102) designed for attachment to the valve cup of an associated aerosol can (not shown). The annular ring (102) is comprised of numerous features as previously described for the annular ring bearing reference numeral (2); the description of most of these features will not be repeated with reference to this embodiment. The projection (102F) from outer surface of the annular wall (102A) of the chassis is discussed further herein (vide infra).

Centrally located within the annular ring (102) and linked to the annular platform (102B) by three flexible struts (103) (two illustrated) is an oblong platform (104) capable of axial movement relative to the annular ring (102). The flexible struts (103) are centrally hinged to aid their flexibility. Two of the flexible struts (103) attach to opposite ends of the oblong platform (104) along its long axis; the third is at right angles to these.

The oblong platform (104) bears inwardly bevelled walls (105) close to each of its long sides, the walls (105) protruding upwards a distance approximately 20% of the breadth of the oblong platform (104). The bevelled walls (105) serve to aid delivery of pressure from the keels (127) protruding from the underside of the actuator button (123) (vide supra) onto the oblong platform (104) of the chassis (101) when the dispenser is actuated.

Figure 11:
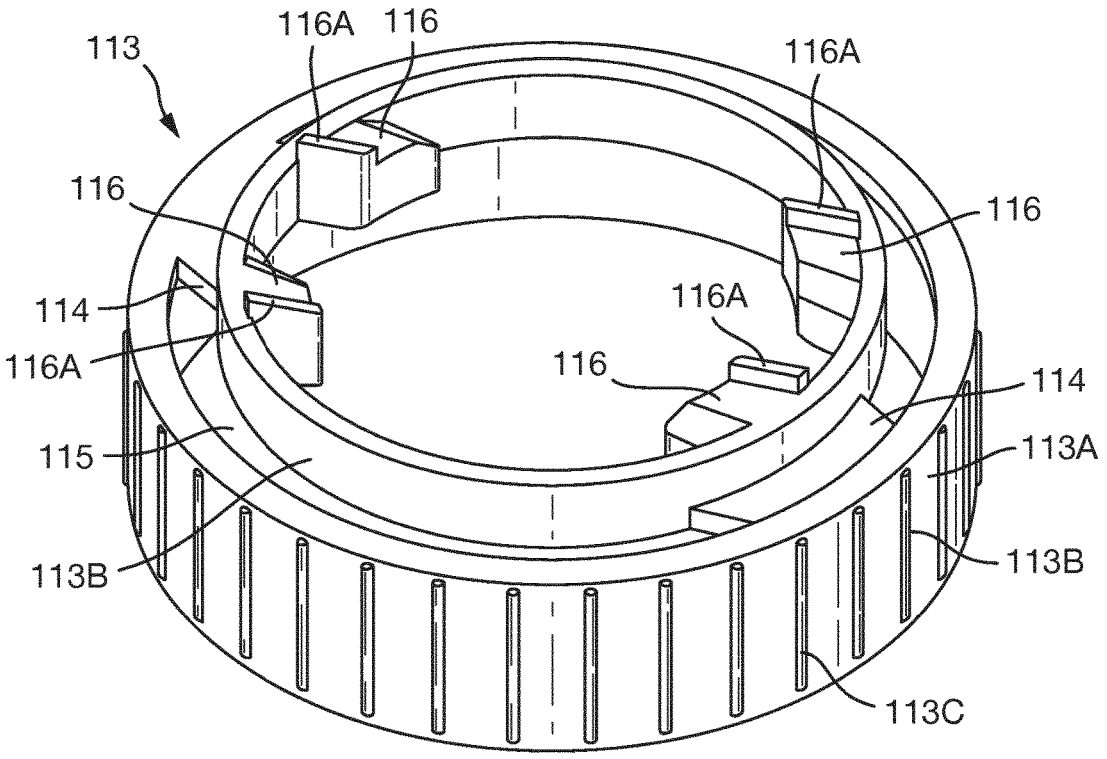
FIG. 11 is a view of an alternative locking collar (113) suitable for use with the chassis (101) illustrated in FIGS. 9 and 10.

FIG. 11 illustrates an alternative locking collar (113) suitable for use with the chassis (101). The locking collar (113) comprises numerous features as previously described for the locking collar bearing reference numeral (13); the description of most of these features will not be repeated with reference to this embodiment.

One feature that is more clearly illustrated on the alternative locking collar (113) is the knurled outer surface (113A) having numerous vertical grip threads (113C) projecting from its surface.

Figure 12:
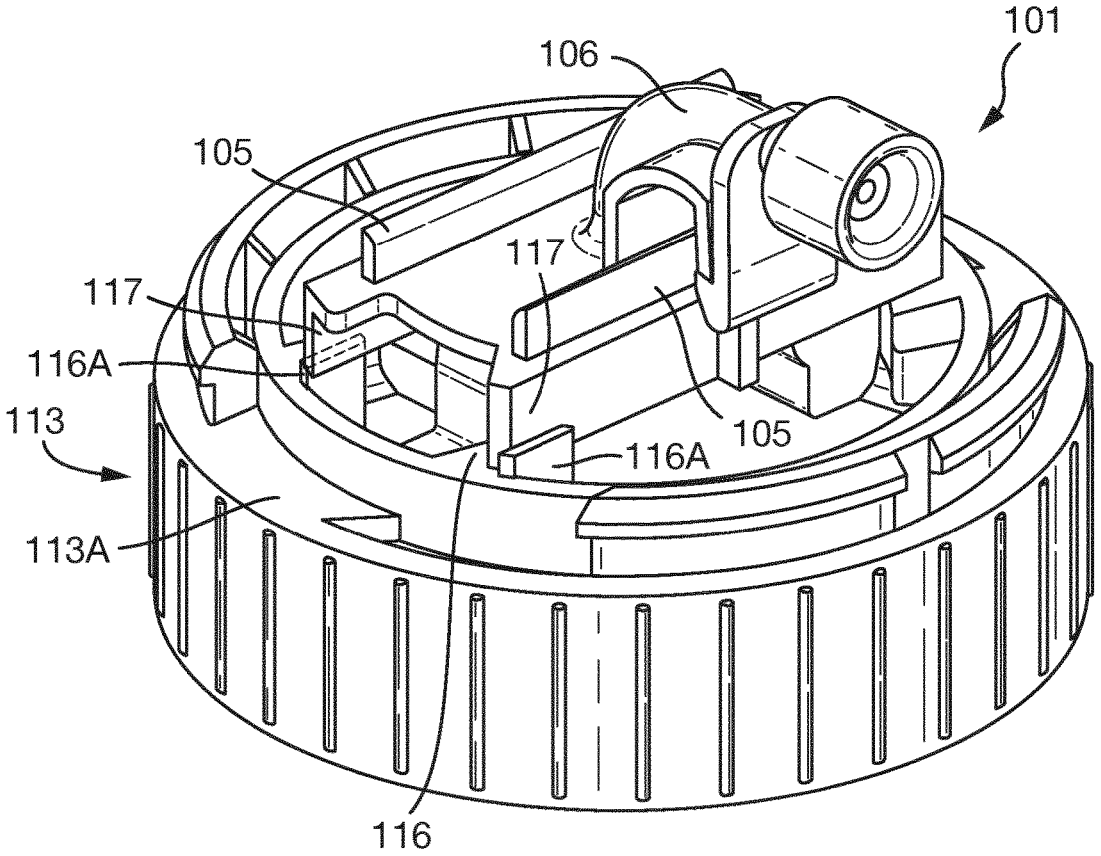
FIG. 12 is a view of the chassis (101) as illustrated in FIG. 9 and the locking collar (113) as illustrated in FIG. 11, the locking collar being positioned to prevent depression of the oblong platform (104).

Further features of the alternative locking collar (113) are four blocking elements (116) projecting inwards from the inner side of an inner collar (113B). These blocking elements each have anti-rotation protrusions (116A) protruding from their upper surfaces towards their counter-clockwise edge. The blocking elements (116) interact with four downward projections (117) from the oblong platform (114) and thereby prevent depression of the latter (see FIG. 12) when the locking collar (113) is rotated to its most clockwise position. In this position, the downward projections (117) from the oblong platform (114) abut the anti-rotation protrusions (116A) protruding upwards from the blocking elements (116) of the locking collar (113) and the platform (104) is prevented from depression because the downward projections (117) from the oblong platform (114) cannot pass the blocking elements (116) of the locking collar (113).

Figure 13:
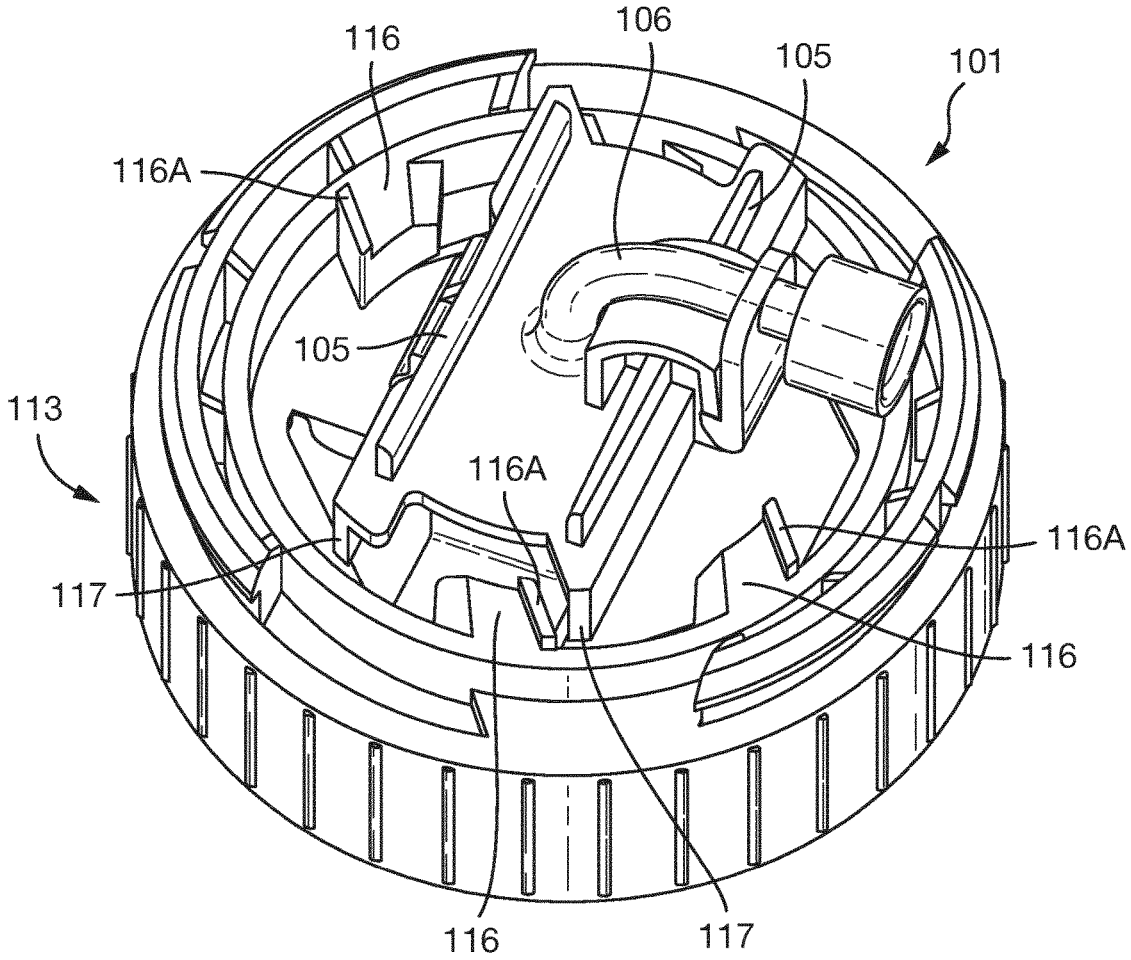
FIG. 13 is a view of the chassis (101) as illustrated in FIG. 9 and the locking collar (113) as illustrated in FIG. 11, the locking collar being positioned to allow depression of the oblong platform (104).

FIG. 13 illustrates the situation when the locking collar (113) is rotated counter-clockwise to a position where the downward projections (117) from the oblong platform (114) may pass the blocking elements (116) of the locking collar (113). In this position, downward pressure upon the platform (106) causes the opening of the valve located under the flexible spray channel (106) and release of the contents of the associated aerosol can.

Figure 15:
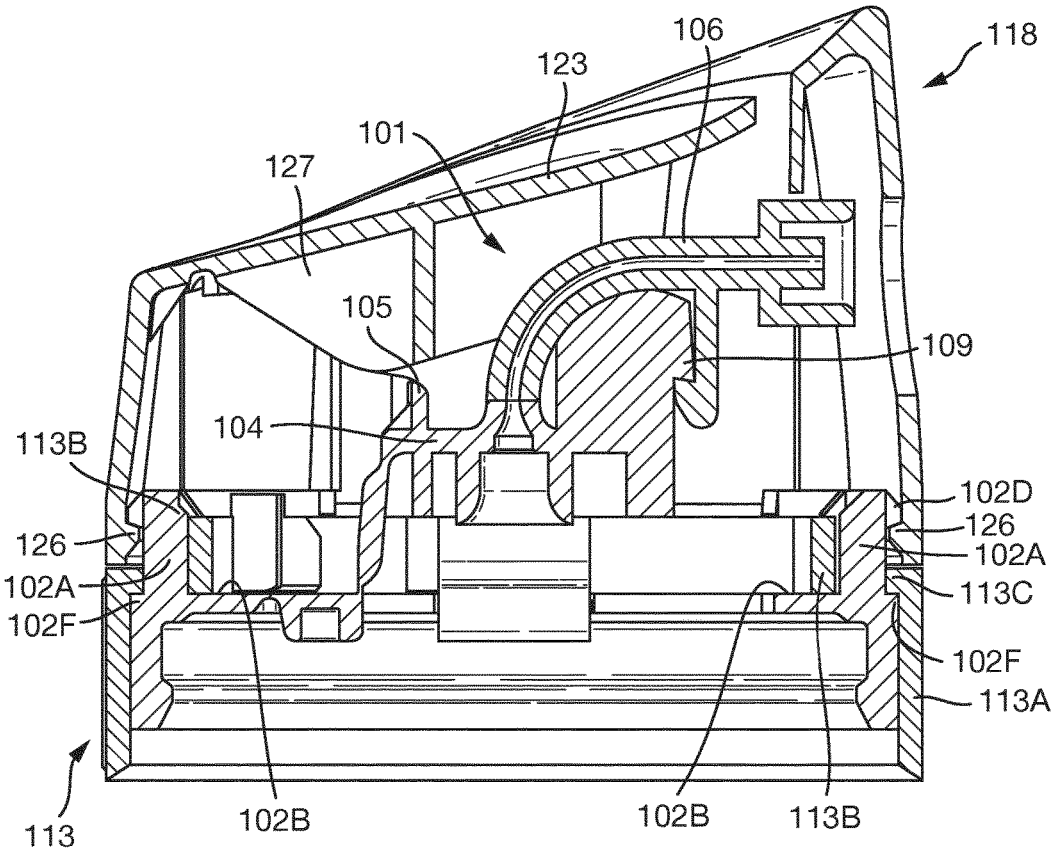
FIG. 15 is a cross-sectional view of the chassis (101) illustrated in FIG. 9 in combination with the locking collar (113) as illustrated in FIG. 11 and the spray-through cap (118) illustrated in FIGS. 14 and 15.

FIG. 15 illustrates the combination of the chassis (101) illustrated in FIG. 9; the locking collar (113) as illustrated in FIG. 11; and the spray-through cap (118) illustrated in FIG. 14. It may be noted that the spray-through cap (118) sits over the chassis (101) and almost abuts the top edge of the locking collar (113) with its lower edge. The spray-through cap (118) is attached to the chassis (101) by means of an incomplete annular bead (126) in the former fitting under an annular lip (102D) in the latter. The incomplete annular bead (126) may also be seen in FIG. 14.

The locking collar (113) has an annular lip (113C) projecting inwards from the upper end of an outer collar (113A) thereof. This inward projecting lip (113C) sits on top of narrow projections (102F) from the outer surface of the annular wall (102A) of the chassis (101), of which there are two (one illustrated in FIG. 9). The projections (102F) are located diagonally opposite one another at either end of a diagonal orthogonal to the long axis of the oblong platform (104). The projections (102F) terminate at an upper height equal to that of the annular platform (102B). The interaction between the inward project lip (113C) and the narrow projections (102F) helps to prevent rocking motion of the locking collar (113) which would otherwise be a problem with it sitting on the chassis (102) merely supported by the linking struts (114) bearing on the annular platform (102B).

With further reference to FIG. 15, it may be seen that the portion of the annular wall (102A) of the chassis (101) that projects upwards through the gap (115) lies between the outer (113A) and inner (113B) collar of the locking collar (113) (see also FIG. 11).

With further reference to FIG. 15, it may be seen that a keel (127) projecting from the underside of the actuator button (123) contacts the rear bevelled wall (105) projecting from the oblong platform (104). Whilst obscured by the spray channel retaining feature (109) in FIG. 15, the keel (127) referred to immediately above also contacts the front bevelled wall (105) projecting from the oblong platform (104), thereby equalising pressure thereupon when the dispenser is actuated. This is true for both keels (127) as depicted in FIG. 14.

The invention of claimed is:

1. An aerosol dispenser head comprising a chassis and a spray-through cap, the chassis comprising an annular ring capable of attachment to an associated aerosol container; a platform attached to the annular ring by struts allowing the platform to rise and fall relative to the annular ring; a flexible spray channel rising vertically from the centre of the platform, the flexible spray channel having a lower end at which the flexible spray channel is attached to a valve stem of an associated aerosol can, and an outer end capable of allowing egress of the contents of the associated aerosol container; and the spray-through cap comprising means for attachment to the chassis or the associated aerosol can; an actuator button, pressure upon which causes downward pressure on the platform of the chassis and consequential downward pressure upon the valve stem attached to the lower end of the associated spray channel; and an aperture positioned to surround the outer end of the spray channel; the chassis further comprising means for holding the flexible spray channel at a pre-selected angle of bend; wherein the dispenser head is actuated by downward pressure upon the actuator button.

2. An aerosol dispenser head according to claim 1, wherein the spray-through cap comprises means for attachment to the chassis.

3. An aerosol dispenser head according to claim 1, further comprising a locking collar that interacts with the chassis platform to allow or prevent depression thereof dependent upon its rotational positioning relative thereto.

4. An aerosol dispenser head according to claim 3, wherein the annular ring of the chassis comprises an upstanding annular wall, a portion of which projects through a partial annular gap in the locking collar.

5. An aerosol dispenser head according to claim 1, wherein the actuator button comprises a keel protruding downwards from its inner surface for transferring pressure on the actuator button into downward pressure upon the platform of the chassis.

6. An aerosol dispenser head according to claim 5, wherein transfer of pressure from the keel onto the platform of the chassis is aided by one or more walls protruding upwards from the platform of the chassis.

7. An aerosol dispenser head according to claim 1, wherein the pre-selected angle of bend for the flexible spray channel is greater than 90° and less than 170°.

8. A method of assembly of an aerosol dispenser comprising the steps of:

1. providing a spray-through cap-chassis assembly by attaching a spray-through cap comprising an aperture to a chassis comprising an annular ring surrounding and attached to a platform capable of axial movement by means of struts between the annular ring and the platform, the chassis comprising a flexible spray channel rising vertically from the centre of the platform and being held at a pre-selected angle of bend by a retaining feature of the chassis wherein the flexible spray channel includes a terminal end and a lower end,
2. attaching the spray-through cap-chassis assembly to an aerosol can comprising a depressible release valve such that the flexible spray channel is attached at its lower end to a valve stem of the depressible valve of the aerosol can, wherein the angle of bend of the spray channel is selected such that the aperture in the spray-through cap surrounds the terminal end of the spray channel, and wherein the spray-through cap-chassis assembly further comprises an actuator button, downward pressure upon which actuates the aerosol dispenser.

9. A method according to claim 8, comprising a preliminary step wherein the flexible spray channel is moulded in a straight vertical orientation and is subsequently bent to an angle of less than 180° and secured at such angle by the retaining feature for the spray channel present on the chassis.

10. A method according to claim 8, wherein the spray-through cap-chassis assembly further comprises a locking collar and wherein a portion of the annular ring of the chassis is pushed upwards through a partial annular gap in the locking collar before the assembly is attached to the aerosol can.

11. A method according to claim 10, wherein the spray-through cap-chassis assembly further comprises a locking collar and wherein a portion of the annular ring of the chassis is pushed upwards through the partial annular gap in the locking collar before the spray-through cap is attached to the chassis.

12. An aerosol dispenser head comprising a chassis, a locking collar, and a spray-through cap, the chassis comprising an annular ring capable of attachment to an associated aerosol container; a platform attached to the annular ring by struts allowing the platform to rise and fall relative to the annular ring; a flexible spray channel rising vertically from the centre of the platform , the flexible spray channel having a lower end at which the flexible spray channel is attached to a valve stem of an associated aerosol can, and an outer end capable of allowing egress of the contents of the associated aerosol container; and the spray-through cap comprising means for attachment to the chassis or the associated aerosol can; an actuator button, pressure upon which causes downward pressure on the platform of the chassis and consequential downward pressure upon the valve stem attached to the lower end of the associated spray channel; and an aperture positioned to surround the outer end of the spray channel; the chassis further comprising means for holding the flexible spray channel at a pre-selected angle of bend;

wherein the locking collar locking collar interacts with the chassis platform to allow or prevent depression thereof dependent upon its rotational positioning relative thereto.

* * * * *